US005890723A

United States Patent [19]

Benoit

[11] Patent Number: 5,890,723

[45] Date of Patent: Apr. 6, 1999

[54] GLIDING ELEMENT SUCH AS AN IN-LINE ROLLER SKATE

[75] Inventor: Louis Benoit, La Balme de Sillingy, France

[73] Assignee: Salomon S.A., Metz-Tessy, France

[21] Appl. No.: 815,917

[22] Filed: Mar. 13, 1997

[30] Foreign Application Priority Data

Mar. 18, 1996 [FR] France ..... 96 03566

[51] Int. Cl.[6] ..... A63C 17/04

[52] U.S. Cl. ..... 280/11.22; 280/11.27

[58] Field of Search ..... 280/11.22, 11.23, 280/11.26, 11.27, 841

[56] References Cited

U.S. PATENT DOCUMENTS

| | | | |
|---|---|---|---|
| 1,970,612 | 8/1934 | Marshall | 280/11.22 |
| 5,193,827 | 3/1993 | Olson | 280/11.22 |
| 5,257,793 | 11/1993 | Fortin | 280/11.22 |
| 5,314,199 | 5/1994 | Olson et al. | 280/7.3 |
| 5,366,232 | 11/1994 | Pozzobon et al. | 280/11.22 |
| 5,411,278 | 5/1995 | Wittmann | 280/11.22 |
| 5,452,907 | 9/1995 | Meilbock et al. | 280/11.22 |
| 5,732,957 | 3/1998 | Yu | 280/11.22 |

FOREIGN PATENT DOCUMENTS

| | | |
|---|---|---|
| 2145520 | 4/1994 | Canada . |
| 2679781 | 2/1993 | France . |
| 4233880 | 1/1994 | Germany . |
| 4425147 | 1/1996 | Germany . |
| WO94/20176 | 9/1994 | WIPO . |

*Primary Examiner*—Richard M. Camby
*Assistant Examiner*—Michael Cuff
*Attorney, Agent, or Firm*—Greenblum & Bernstein, P.L.C.

[57] ABSTRACT

In-line roller skate constituted by a longitudinal frame on lower portion of which a plurality of skating wheels are arranged, and by a boot constituted by a shell base extended toward the skater's ankle by an upper, and a sole of which is associated with the frame, directly or via an up plate of the frame or a cradle, wherein a detachable linkage arrangement is interposed between the frame and the boot sole, whether or not via a plate or cradle, and is constituted by at least one wedge-shaped lateral flange obtained on an upper portion of the frame and capable of cooperating with a corresponding housing of the sole, plate or cradle, via a tightening member in order to obtain a linkage by progressive wedging effect, resulting in an automatic backlash elimination, between the flange of the frame and the sole, plate or cradle.

16 Claims, 1 Drawing Sheet

GLIDING ELEMENT SUCH AS AN IN-LINE ROLLER SKATE

BACKGROUND OF THE INVENTION

1. Field of the Invention

The present invention relate to a gliding element such as a roller skate, in-line roller skate, or ice skate. This type of skate is generally constituted by a longitudinal frame on a lower portion of which the gliding elements are arranged, i.e., a plurality of wheels or a skating blade, and by a boot whose sole in associated with the frame, directly or via an upper plate of the frame.

2. Background and Material Information

This type of skate can be adapted to the training of the skater on ice, outside of a skating rink, but also for any athletes eager to maintain or perfect, on a hard or tarred ground, the techiques used in gliding sports such as trail skiing, cross country skiing, ice skating, etc.

In known skates of this type, the linkage of the boot on the frame is generally fixed and without possibility of disassembly by the skater.

As a result, it is necessary to replace this assembly, in fact the entire skate, when the frame or the boot are damaged.

It is understood that a substantial expense is incurred whereas replacing either of the elements would be sufficient to restore a partially damaged skate.

furthermore, another drawback encountered with the currently available skate lies in the fact that the morphology of the skater's foot is not necessarily adapted to the orientation of the boot with respect to the frame of the skate.

In fact, no angular adjustment means enable such adaptation.

SUMMARY OF THE INVENTION

An object of the invention is to propose an improved and easier arrangement for assembling the frame on the boot, and to also enable an angular adjustment of the boot with respect to this frame.

To remedy these various disadvantages, the present invention relates to a gliding element such as a skate, constituted by a longitudinal frame on a lower portion of which the gliding element(s) is(are) arranged, and by a boot constituted by a sole or shell capable of being associated with the frame, wherein a detachable linkage is interposed between the frame and the boot sole, and wherein it is constituted by at least one lateral flange having ramp-shaped surfaces obtained on an upper portion of the frame and capable of cooperating with corresponding ramp-shaped surfaces of the sole, by means of a transverse tightening mechanism in order to obtain a linkage by progressive wedging effect between the flange of the frame and the sole.

A rapid and easily accessible assembly or disassembly of a boot on a frame is obtained without it being necessary to disassemble other elements such as wheels, blades, etc. This is obtained because the tightening action to perform the linkage or disassembly of the frame with respect to the boot occurs in a direction transverse to the latter due to the effect of the ramps.

BRIEF DESCRIPTION OF THE DRAWINGS

The present invention is also related to the features which will become apparent along the following description, and which must be considered separately or according to all of their possible technical combinations.

This description, provided by way of a non-limiting example, will help to better understand how the invention can be embodied, with reference to the annexed drawings, in which.

DETAILED DESCRIPTION OF THE PREFERRED EMBODIMENTS

Figure 1:
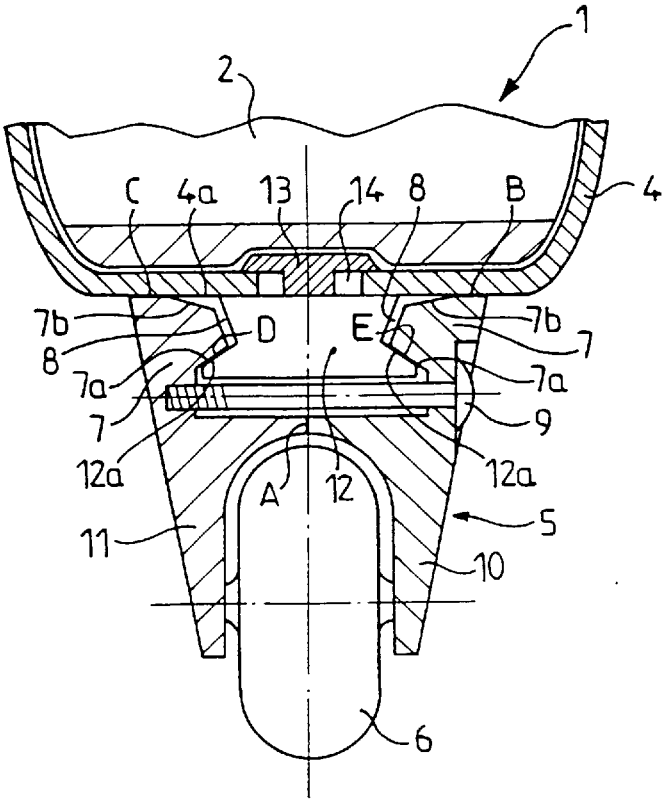
FIG. 1 is a transverse cross-sectional view of a lower portion of a skate according to the invention, showing the means arrangement for linking a frame to a boot, according to a first embodiment.

The in-line roller skate generally designated by reference numeral 1 and shown in FIG. 1 includes a boot 2 adapted to be affixed, through a shell portion or external sole 4, to a frame 5 on which the wheels 6 are arranged.

The rigid seal 4 is affixed to the frame 5 via a linkage assembly, mentioned above as relating to an object of the present invention.

This linkage assembly is detachable and is interposed between the frame 5 and the shell 4.

This assembly is constituted by two lateral flanges 7 having ramp-shaped surface obtained on an upper portion of the frame 5 and capable of cooperating, in view of a wedging effect, with one of the complementary ramp-shaped portions 8 provided on an element affixed to the shell 4. This is done by means of a tightening mechanism 9 enabling the ramps to progressively come closer to one another in order to obtain a linkage by progressive wedging effect, as well as an automatic backlash elimination, between the flanges 7 of the frame 5 and the shell 4.

According to the example shown in FIG. 1, the frame 5 is constituted by two lateral flanges 10 and 11, each including, at its upper portion, a flange 7 having a wedge-shaped zone having one lower ramp 7*a* and one upper ramp 7*b*, ascending and descending, respectively, and capable of cooperating with associated ramps, 12*a*, 4*a*, respectively, of a dovetail-shaped element 12 provided beneath the shell 4 and of a lower plane 4*a* of the latter.

The coupling of the two lateral flanges 10 and 11 occurs by means of a tightening screw 9 extending transversely through the flange 10 being screwed into the flange 11, its action resulting into bringing the flanges 10 a 11 closer, together through the progression of the lower raps 7*a* of the flanges 7 on the corresponding ramps 12*a* framed by the wings of the dovetail 12, until upper ramps 7*b* of the flanges 7 come into contact, then into wedging on corresponding zones of the plane 4*a* of the shell 4, constituting upper ramps of the wedging zone. As can be seen in the Figures, the head of the screw 9 is manipulable at one of the flanges 7.

Thus, as shown in the Figure, contact points or zones D and E are first created until upper contact points or zones C and B corresponding to a definitive immobilization of the frame on the shell are created.

As also seen in FIG. 1, the two lateral flanges 10 and 11 include a parting line A. The sizing of the various constituent portions of these flanges is such that when they enter into contact in the zone A, the upper flanges 7 tighten on the zones D and E, then C and B by elastic deformation. Of course, the flanges 10 and 11 are in this case made out of a material that allows such deformation.

Nevertheless, if the flanges were made of a non-deformable material, it would suffice to eliminate the parting line A so as to enable the same tightening of the flanges 7 in the zones D, E, and C, B, naturally through the translation of one of the flanges to the other.

Figure 2:
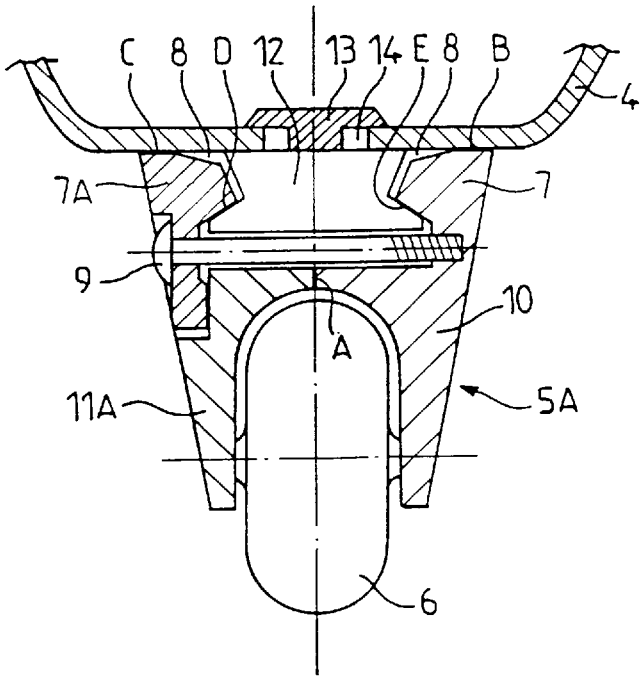
FIG. 2 is a transverse cross-sectional view of a, lower portion of a skate according to the invention, showing the arrangement for linking a frame to a boot, according to a second embodiment.
Figure 3:
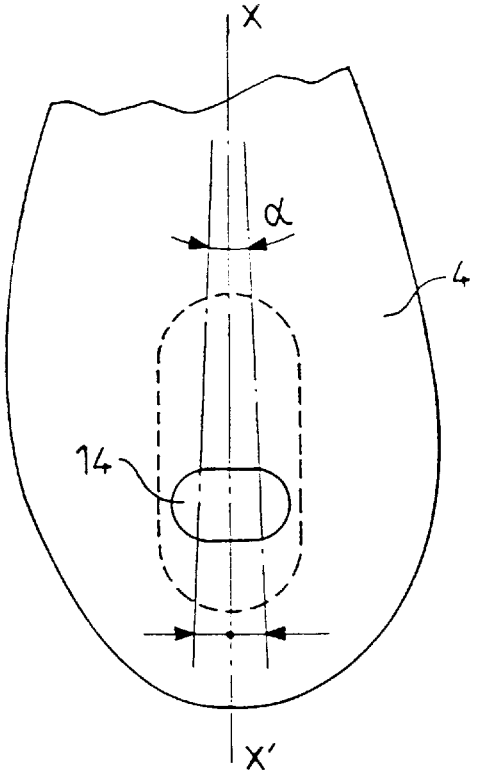
FIG. 3 is a top view according to one of FIGS. 1 or 2.

The example of the embodiment shown in FIG. 2 essentially differs from the previous in that one of the lateral flanges 11A constituting the frame 5A includes a flange portion 7A that is attached on such flange 11A by means of the same screw 9 for tightening the flanges 10 and 11A to one another.

Such an arrangement is more particularly adapted to a frame whose flanges are rigid. Nevertheless, the functioning of this device according to FIG. 2 is identical to that of FIG. 1.

One can very well imagine that the dovetail-shaped element 12 is fixed with respect to the shell 4.

Nevertheless, and preferably, the dovetail-shaped element 12 is retained axially on the shell 4 by means of an axle or other retaining element 13 extending freely through a transverse slot or through hole 14 of such shell 4, and being screwed into such dovetail elements 12 so as to allow for an essentially angular lateral movement, along an angle "α" determined by the position of the axle 13 in the slot 14, of the boot 2 with respect to the frame 5 thus ensuring a self-adaptation of the morphology of a user's foot to the skate 1, such adaptation occurring before the definitive tightening of the linkage member.

Preferably, the dovetail element 12 angularly adjustable along the angle "α" and constituting the means for linking the frame 5 with the shell 4, is arranged along the longitudinal axis plane XX' of the skate 1 in the zone of the metatarsal bones of the skater's foot. Nevertheless, this device can be obtained in the heel zone.

Another advantage of the invention, such as has just been described, consists in that it is possible to obtain the aforementioned angular adjustment, without dismounting the wheels as required currently by simply displacing the dovetail element with respect to the shell 14 of the boot after unscrewing, then screwing back the axle 13.

The instant application is based upon French Priority Patent Application No. 96.03566, filed on Mar. 18, 1995, the disclosure of which is hereby expressly incorporated by reference thereto, and the priority of which is hereby claimed under 35 U.S.C. §119.

What is claimed:

1. A gliding device comprising:

a longitudinally extending frame having a lower portion and an upper portion;

at least one gliding member arranged on said lower portion of said frame;

a boot having a sole capable of being secured to said frame, said sole having a projection and ramp-shaped surfaces;

a detachable linkage assembly interposed between said frame and said boot sole, said linkage assembly comprising at least two laterally spaced apart lateral flanges having ramp-shaped surfaces provided at said upper portion of said frame; said projection of said sole having a shape complementary to said lateral flanges; said two lateral flanges of said detachable linkage assembly being arranged to engage said complementary shaped projection of said boot sole;

said detachable linkage assembly further comprising a transverse tightening member, said transverse tightening member passing through at least one of said lateral flanges to exert a progressive wedging effect between said lateral flanges and said complementary shaped projection and to release said boot from said frame without necessitating release of said wheels with respect to said frame.

2. A gliding device according to claim 1, wherein:

said at least one gliding member comprises a plurality of in-line rollers, said gliding device thereby comprising an in-line roller skate.

3. A gliding device according to claim 1, wherein:

said projection of said sole comprises a downwardly projecting dovetail-shaped element, said dovetail-shaped element having a pair of laterally opposed lateral wings;

said ramp-shaped surfaces of said sole are defined by surfaces of said dovetail-shaped element and a lower plane of said sole, each of said lateral flanges having a pair of ramp-shaped surfaces, each of said pair of ramp-shaped surfaces of said lateral flanges being in engagement with a respective one of said surfaces of said dovetail-shaped element and a lower plane of said sole;

said transverse tightening member comprises a tightening screw extending transversely through one of said lateral flanges and being screwed into another of said lateral flanges, whereby a tightening of said screw brings said lateral flanges closer together, and said lateral flanges are wedged through a progression of said ramp-shaped surfaces of said lateral flanges with said ramp-shaped surfaces of said dovetail-shaped element and said lower plane of said sole.

4. A gliding device according to claim 3, wherein:

at least one of said lateral flanges of said frame includes a flange portion, said flange portion includes said ramp-shaped surfaces of said one of said lateral flanges; and said tightening screw secures said flange portion to said one of said lateral flanges.

5. A gliding device according to claim 3, wherein:

said dovetail-shaped element is fixed against movement with respect to said sole.

6. A gliding device according to claim 4, wherein:

said dovetail-shaped element is fixed against movement with respect to said sole.

7. A gliding device according to claim 3, wherein:

said sole includes a through-hole; and said dovetail-shaped element is movably fixed to said sole with a retaining member extending upwardly and freely through said through-hole of said sole, whereby said boot is angularly movable.

8. A gliding device according to claim 7, wherein:

said boot has a longitudinal plane; and said dovetail-shaped element extends along said longitudinal plane of said boot.

9. A gliding device according to claim 7, wherein:

said dovetail-shaped element extends along said longitudinal plane of said boot and is positioned in a zone corresponding to metatarsal bones of a user's foot.

10. A gliding device according to claim 4, wherein:

said sole includes a through-hole; and said dovetail-shaped element is movably fixed to said sole with a retaining member extending upwardly and freely through said through-hole of said sole, whereby said boot is angularly movable.

11. A gliding device according to claim 10, wherein:

said boot has a longitudinal plane; and said dovetail-shaped element extends along said longitudinal plane of said boot.

12. A gliding device according to claim 10, wherein:

said dovetail-shaped element extends along said longitudinal plane of said boot and is positioned in a zone corresponding to metatarsal bones of a user's foot.

13. An in-line roller skate comprising:

a longitudinally extending frame having a lower portion and an upper portion, said lower portion comprising a pair of laterally spaced lateral flanges;

a plurality of rollers arranged between said lateral flanges of said lower portion of said frame;

a boot having a sole capable of being secured to said upper portion of said frame;

a linkage assembly removably connecting said boot and said frame, said linkage assembly comprising means for, selectively, (1) tightening said boot with respect to said frame, and (2) releasing said boot with respect to said frame without necessitating release of said wheels with respect to said frame, said means including a transversely extending tightening member extending between said lateral flanges.

14. An in-line roller skate according to claim 13, wherein:

said means further comprises means for angularly adjusting said boot with respect to said frame without necessitating release of said wheels with respect to said frame.

15. An in-line roller skate according to claim 13, wherein:

said transversely extending tightening member comprises a screw having a head manipulable at one of said pair of laterally spaced flanges.

16. An in-line roller skate according to claim 15, wherein:

said screw extends transversely above said wheels.

* * * * *